US005295471A

United States Patent [19]

Ridgway et al.

[11] Patent Number: 5,295,471

[45] Date of Patent: Mar. 22, 1994

[54] ELECTRONIC ENGINE CONTROL INTERFACE

[75] Inventors: Robert W. Ridgway, Royal Oak, Mich.; Keith Z. Doorenbos, Hiroshima, Japan

[73] Assignee: Ford Motor Company, Dearborn, Mich.

[21] Appl. No.: 824,620

[22] Filed: Jan. 23, 1992

[51] Int. Cl.[5] ..... F02D 41/22

[52] U.S. Cl. ..... 123/479; 364/431.11

[58] Field of Search ..... 123/479; 364/431.11; 371/68.3, 68.2, 68.1, 67.1

[56] References Cited

U.S. PATENT DOCUMENTS

| | | | |
|---|---|---|---|
| 4,122,995 | 10/1978 | Franke | 371/68.3 |
| 4,312,315 | 1/1982 | Takase | 123/479 |
| 4,414,949 | 11/1983 | Honig et al. | 123/479 |
| 4,476,830 | 10/1984 | Hasegawa et al. | 123/479 |
| 4,502,447 | 3/1985 | Schnürle et al. | 123/479 |
| 4,628,882 | 12/1986 | Sakurai et al. | 123/479 |
| 4,797,828 | 1/1989 | Suzuki et al. | 123/479 |
| 4,825,373 | 4/1989 | Nakamura et al. | 364/431.05 |
| 4,941,445 | 7/1990 | Deutsch | 123/479 |

FOREIGN PATENT DOCUMENTS

| | | | |
|---|---|---|---|
| 58-158346 | 9/1983 | Japan | 123/479 |

*Primary Examiner*—Andrew M. Dolinar

*Attorney, Agent, or Firm*—Peter Abolins; Roger L. May

[57] ABSTRACT

An electronic fuel injection system in which an electronic engine control module connected to engine-position-responsive sensors generates a cylinder identification waveform which is synchronized with a fuel demand control waveform. The two waveforms are transmitted to an electronic driver module which distributes high-level actuating signals to the individual fuel injectors based on the two waveforms received from the engine control module. To assure the reliability of the communication link connecting the two modules, synchronized signal excursions on the two waveforms are displaced in time one from another by a preset delay interval. At the driver module, the delay interval between corresponding excursions on the two received waveforms is measured and, if the measured interval deviates substantially from the preset interval as transmitted, the generation of actuating pulses is inhibited to prevent potentially dangerous engine surging. Waveform generation and measurement is accomplished the microcontroller used to implement the engine control and driver modules.

3 Claims, 1 Drawing Sheet

ELECTRONIC ENGINE CONTROL INTERFACE

This invention relates to automotive engine control systems and more particularly to an arrangement for insuring that critical control signals are correctly transmitted between separate modules within an engine control system.

SUMMARY OF THE INVENTION

Electronic control elements are increasingly being substituted for the mechanical devices traditionally used in internal combustion engines. Engine performance may be substantially improved by ignition and fuel delivery mechanisms which are adaptively timed and controlled by microcomputers which process signals from engine condition sensors. Typically, a central electronic engine control (EEC) module is connected to sensing transducers and includes a microcomputer which generates timing and control signals. The signals from the EEC are then transmitted to other electronic modules which may themselves include a microcomputer and which are positioned at or near the instrumentality to be controlled. For example, the timing signals for operating the fuel injection system are typically generated within the EEC and then transmitted to an electronic drive unit which is positioned near the injectors themselves, the drive unit generating and delivering higher power signals which actuate the individual fuel injectors, the timing of these drive signals being derived from the lower power control signals received from the EEC.

Reliable communication of the control signals between the modules making up an engine control system is essential if the engine is to operate properly. Incorrect transmission of the timing information which controls the engine's electrically-operated fuel injectors, for example, could cause the engine to surge or run roughly. It is accordingly a principal object of the present invention to insure the reliable transmission of control and timing signals between the control signal generating unit and the remotely positioned electronic devices which utilize these signals.

It is a more specific object of the invention to monitor the accuracy of the fuel delivery control signals generated by an electronic engine control unit and transmitted to the fuel injector driving circuits which respond to these signals.

It is a related object of the present invention to interrupt the operation of electrically-operated fuel injectors when the integrity of the timing signals which control those injectors is compromised by ambient electromagnetic noise signals or other causes.

It is a further object of the invention to increase the reliability of the communication link between a microcomputer-based engine control unit and a microcomputer-based device-driver unit, and to do so without significantly adding to the cost of the system by using components already present in the system.

The present invention takes the form of a method and apparatus for monitoring a control signal communications link connecting a source of control signals to a utilization device. The control signal generator includes means for developing a pair of control signals which exhibit identifiable signal excursions which are displaced in time by a predetermined duration. At the utilization device, the time duration separating these excursions is measured to insure that it remains substantially equal to the time displacement introduced at the time of transmission.

The principals of the invention may be advantageously implemented to insure the reliable operation of the fuel injector driving signal generator which responds to timing signals supplied by an electronic engine control module. Both the driving signal generator and the engine control module include microcontrollers for generating output signals in response to supplied input signals, and these same microcontrollers may be readily programmed to carry out the functions contemplated by the invention without incurring the expense of additional monitoring devices. The microcontroller within the electronic engine control (EEC) module conventionally generates a pair of fuel injection timing signals, the first being a fuel delivery control signal (FCDS) comprising a sequence of pulses, each pulse being generated when a fuel injector associated with a particular cylinder is to be energized, and the second timing signal being a cylinder identification (CI) waveform which, in combination with the FCDS waveform, indicates which of the plural injectors is to be energized.

In accordance with the invention, the EEC microcontroller which generates these two control waveforms delays the signal excursions in the output CI waveform by a predetermined displacement interval with respect to corresponding signal excursions in the FCDS waveform. The drive signal generator includes a second microcontroller which processes these two waveforms from the EEC module to control semiconductor power switching devices which supply the high-voltage pulses to actuate the fuel injectors. In accordance with the invention, this second microcontroller measures the time interval between corresponding signal excursions manifested by the two received waveforms. In the event the measured value deviates substantially from the predetermined delay interval present at the time of transmission, the drive signal generator inhibits the further generation of fuel-injector driving signals until the proper timing is restored.

The communications link monitoring scheme contemplated by the invention prevents the engine from surging due to the deleterious effects of ambient electromagnetic noise or other causes.

These and other objects, features and advantages of the present invention will become more apparent through a consideration of the following detailed description of a preferred embodiment of the invention. This description should be read in conjunction with the attached drawings, in which:

DETAILED DESCRIPTION

Figure 1:
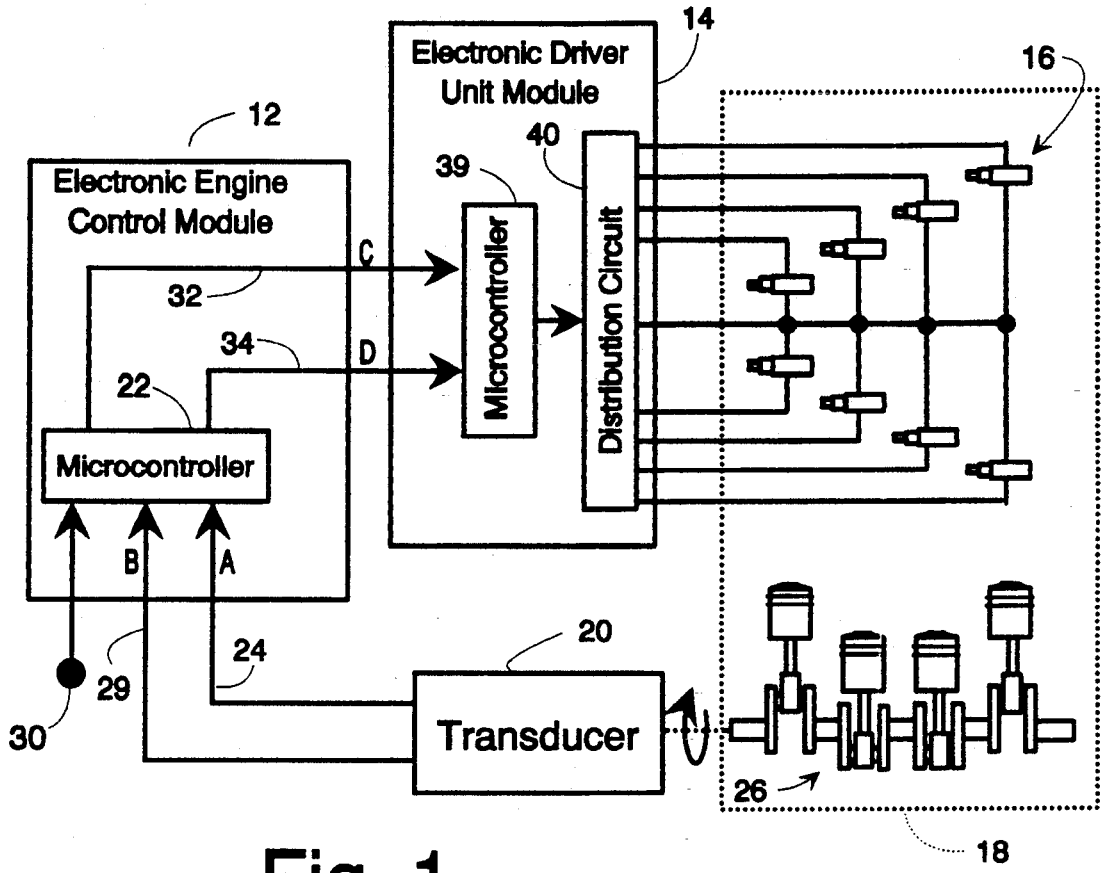
FIG. 1 is a block schematic of a preferred arrangement for monitoring the integrity of a control signal interface between the control signal generator and the drive signal generator of an fuel injection system.

The preferred embodiment of the invention is an arrangement for monitoring the operation of the data link over which fuel injection control signals are transmitted from their source (the electronic engine control module seen at 12 in FIG. 1) to their destination (the electronic driver unit module 14). These two modules function together to produce the high-level signals which are applied to actuate the fuel injectors indicated generally at 16. Each of the fuel injectors is physically integrated with the internal combustion engine depicted within the dotted rectangle 18 and is positioned to inject fuel into its associated cylinder. The fuel injectors are of conventional design and supply fuel to the interior of the cylinders at a time and for a duration dictated by the timing and duration of an electrical actuating signal supplied by the driver module 14.

The actuating signals supplied to the fuel injectors are synchronized with the motion of the engine's camshaft. One or more transducers, seen at 20 in FIG. 1, supply a pair of engine position signals to input ports of a microcontroller 22 in the EEC module 12. The first of these signals is a pulse train A communicated on conductor 24 which is characterized by the presence of a pulse each time the engine crankshaft, indicated generally at 26, rotates through two revolutions and is in a predetermined rotational position within the engine cycle (or, more conveniently, each time an engine camshaft rotates through one revolution). Thus, the pulse train A establishes a fixed time within each engine cycle, such as the top-dead-center (TDC) position of a selected one of the engine pistons during a particular stroke. The second signal from the transducer 20 is a train of pulses, waveform B on conductor 29, which is characterized by the presence of a pulse each time the engine crankshaft rotates by a predetermined incremental angle.

The two waveforms A and B are applied to input ports of a microcontroller 22 within the EEC module 12. The microcontroller 22, like the microcontroller 39 to be discussed later, is a "microcomputer" (a complete computer implemented as a single integrated circuit) and comprises a microprocessor and a read-only memory (ROM) which stores the programs executed by the microprocessor to provide the desired functionality. These microcontrollers further include a built-in timer capable of simultaneously generating interrupts to a program at a periodic rate, measuring the timing and duration of external events, and generating measured output waveforms. Finally, each of the microcontrollers 22 and 39 includes a serial communications interface which permit the microcontroller to transmit and receive data serially over single wire communications links. Such microcontrollers, the details of which are not shown in FIG. 1, are available from a variety of sources and include Motorola 6800 family of devices which are described in detail in *Motorola's Microcontroller and Microprocessor Families*, Volume 1 (1988), published by Motorola, Inc., Microcontroller Division, Oak Hill, Tex.

The microcontroller 22 in EEC module 12 receives the two waveforms A and B from the transducer 20, and an additional signal via an input conductor 30 which specifies the amount of fuel to be supplied to the engine. The microcontroller then produces two output waveforms C and D which are supplied to the EDU module 14 via conductors 32 and 34 respectively.

Figure 2:
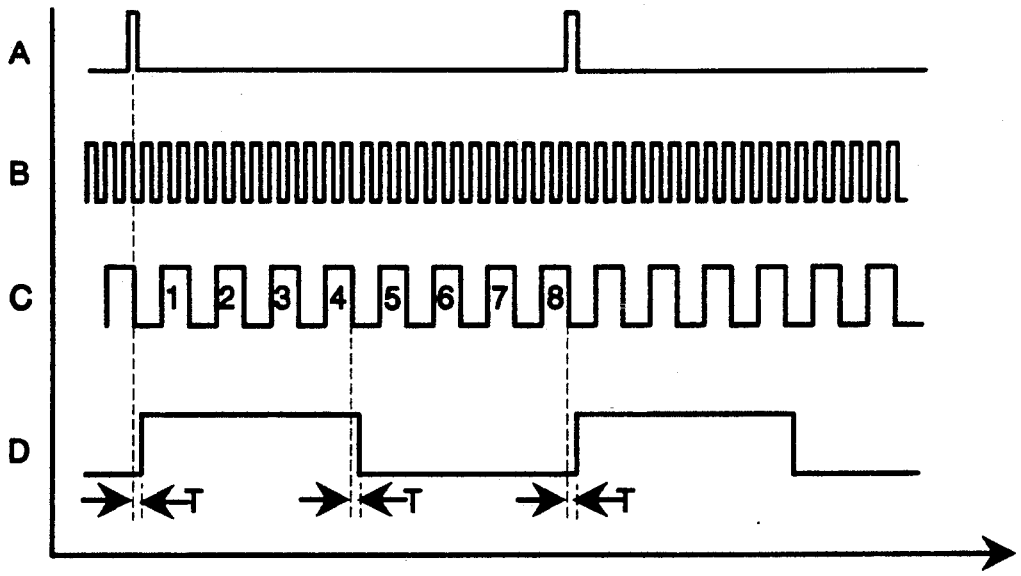
FIG. 2 is a graph showing the relationship between various signal waveforms appearing in the arrangement shown in FIG. 1.

The four waveforms A, B, C and D have a timed relationship which is illustrated by the waveshapes seen in FIG. 2 of the drawings. The timing within each engine cycle begins with an event, indicated by the vertical dotted line in FIG. 2, which occurs when the edge of one of the pulses in waveform B exists simultaneously with the pulse in waveform A. From the three input signals it receives, the microcontroller 22 derives the train of fuel demand control signal (FCDS) pulses which are delivered via the output conductor 32. Each of the FCDS pulses begins in synchronism with a selected one of the pulses in waveform B at a time determined by counting waveform B pulses. The duration of these pulses is dictated by the fuel control signal supplied via input line 30 to the microcontroller 22.

In order to inform the EDU module 14 which of the FCDS pulses is to be routed to which fuel injector, the microprocessor 22 also generates a cylinder identification (CI) signal depicted as waveform D if FIG. 2. The CI waveform assumes a first (high) state during the FCDS pulses for cylinders 1–4 and a second (low) state during the FCDS pulses for cylinders 5–8. The microcontroller 22 times the leading edge of each CI waveform excursion such that it trails a corresponding excursion in the FCDS waveform C by a predetermined delay interval T seen in FIG. 2. This brief delay insures that the CI and FCDS excursions are no coincident in order that the CI waveform will unabiguously identify the position within the engine cycle of each FCDS pulse. In addition, as discussed below, the time displacement between signal excursions in the CI and FCDS waveforms further provides the monitoring capability contemplated by the invention.

The microcontroller 39 within the EDU modula 14 responds to the combination of the fuel demand control signal (waveform C in FIG. 2) and cylinder identification signal (waveform D in FIG. 2) to route each FCDS pulse to the correct one of the fuel injectors 16 via a distribution circuit 40 which supplies signals of adequate voltage to properly actuate the injector mechanisms.

In addition, the microcontroller 39 measures the time displacement interval T exhibited by the two received waveforms. The microcontroller 39 then compares this measured interval with the expected interval, which has a value set by the microcontroller 22 at the transmission end, but which will vary in the presence of substantial interference or a malfunction in the communication link between modules 12 and 14. If the measured time interval and the expected time interval deviate by more than a predetermined magnitude, the microcontroller terminates the further delivery of FCDS pulses to the cylinders until synchronization can be re-established.

In this way, the monitoring arrangement contemplated by the invention is able to prevent potentially dangerous engine surges which might otherwise result when the integrity of the command signal communication path is compromised by high-level noise signals or other causes.

It is to be understood that the specific mechanisms and techniques which have been described are merely illustrative of one application of the principles of the invention. Numerous modifications may be made to the methods and apparatus described without departing from the true spirit and scope of the invention.

What is claimed is:

1. The method of reliably actuating the fuel injectors in an electronically controlled fuel injection system for an internal combustion engine which comprises, in combination, the steps of:

generating a cylinder identification waveform which exhibits signal excursions at predetermined positions of the pistons during each operating cycle of said engine, generating a fuel demand control signal which is synchronized with said cylinder identification waveform and which exhibits identifiable signal excursions which are delayed from corresponding signal excursions in said cylinder identification waveform by a predetermined delay interval, transmitting said cylinder identification signal and said fuel demand control signal to a driver module, generating within said driver module an actuation signal to be sequentially applied to said fuel injectors in response to said cylinder identification signal and said fuel demand control signal, measuring within said driver module the time duration by which signal excursions in said fuel demand control signal as received are delayed from corresponding excursions in said cylinder identification signal as received, and indicating a trouble condition whenever said time duration as measured differs substantially from said predetermined delay interval.

2. The method as set forth in claim 1 further including the step of inhibiting the generation of said actuation signals whenever said trouble condition is indicated to prevent said engine from receiving fuel as long as said trouble condition persists.

3. In combination with a multi-cylinder internal combustion engine having an electrically-operated fuel injector associated with each cylinder, each of said injectors having electrical power input terminals and each injector being adapted to deliver measured quantities of fuel to said cylinder in response to the energization of said terminals, transducer means responsive to the motion of said engine for generating a first timing signal each time said engine rotates by a predetermined rotational increment, and for generating a second timing signal each time said engine rotates to a predetermined angular position within its operation cycle, an electronic control signal generator coupled to said transducer to receive said first and second timing signals for generating a fuel delivery control signal and a cylinder identification control signal, said control signal generator including first timing means for establishing a predetermined time displacement between said fuel delivery control signal and said cylinder identification control signal, an electrical drive signal generator positioned remotely from said control signal generator and connected thereto by a control signal transmission path, said drive signal generator being responsive to said control signals and applying drive signals to said power input terminals of said fuel injectors, said drive signals being derived from the combination of said fuel delivery control signal and said cylinder identification signal, said drive signal generator further including second timing means for measuring the duration of the time displacement between said control signals as received by said drive signal generator, and for discontinuing the generation of said drive signals whenever said measured duration deviates substantially from said predetermined time displacement established by said first timing means.

* * * * *